United States Patent [19]

Lewey et al.

[11] 3,938,671

[45] Feb. 17, 1976

[54] METHOD AND APPARATUS FOR HANDLING LARGE FABRIC ROLLS FOR SLITTING

[75] Inventors: Ernest L. Lewey, Greensboro; Ned K. Sharpe, Burlington; James F. Sloan, Greensboro, all of N.C.

[73] Assignee: Burlington Industries, Inc., Greensboro, N.C.

[22] Filed: Aug. 13, 1974

[21] Appl. No.: 497,032

[52] U.S. Cl. ..... 214/1 R; 82/47; 214/1 B; 214/1.1; 214/1 BD; 214/147 T; 214/DIG. 4; 214/152

[51] Int. Cl.[2] ..... B65G 61/00

[58] Field of Search ..... 214/1 B, 91 R, 1.1, 1 R, 214/DIG. 4, 1.5, 147 R, DIG. 1, 1 BD, DIG. 3, 152, 147 T, 147 G; 242/56.6, 58.6, 79; 82/47, 70, 102, 43, 44; 83/23, 25, 401, 649, 650

[56] References Cited

UNITED STATES PATENTS

| | | | |
|---|---|---|---|
| 2,555,753 | 6/1951 | Montgomery | 214/1.5 |
| 2,624,476 | 1/1953 | Schmidt | 214/DIG. 4 X |
| 2,802,586 | 8/1957 | Wingard | 242/79 X |
| 2,803,363 | 8/1957 | Hutchinson | 214/DIG. 4 X |
| 2,943,729 | 7/1960 | Dalrymple | 82/44 X |
| 3,522,748 | 8/1970 | Treffner | 82/47 X |

*Primary Examiner*—Frank E. Werner
*Attorney, Agent, or Firm*—Cushman, Darby & Cushman

[57] ABSTRACT

A method and apparatus for handling a large fabric roll and an interengaging spindle therefor before and after a slitting operation in which the roll and spindle are supported in initial handling positions in longitudinal spaced and aligned relation, the spindle being supported initially at two positions at its end portions and moved longitudinally by the support at its remote end portion into interengaged relation, during which movement, the support at the other end portion is progressively changed in a direction toward the remote end and then removed after the end portion has initially engaged within the roll. The slitting operation is performed after support of the roll has been transferred to the outwardly extending spindle end portions and the roll has been transversely moved into an operative slitting position. The handling procedures are substantially reversed after the slitting operation.

11 Claims, 12 Drawing Figures

METHOD AND APPARATUS FOR HANDLING LARGE FABRIC ROLLS FOR SLITTING

This invention relates to the slitting of rolls of web material and more particularly to an improved method and apparatus of handling such rolls before and after the slitting operation.

Slitting machines for cutting rolls of web material such as fabric by moving a circular cutting blade rotating about an axis parallel with the axis of the roll transversely from the exterior periphery of the roll to the interior periphery thereof have been in use for many years in the textile industry. Generally, the rolls processed through the slitting operation have been of a sufficiently small size as to present little difficulty in handling both before and after the slitting operation. Until recently, large rolls of the order of 144 inches wide (measured axially) and 45 inches in diameter were slit by the unwind-slit-and rewind method rather than by the more common roll slitting method employed with smaller rolls. Roll slitting is well recognized to be more advantageous than unwind slit and rewind slitting both in terms of speed and efficiency.

Roll slitting machines embodying a 60 inch diameter circular cutting blade are now commercially available with the capability of slitting rolls up to 48 inches in diameter and 156 inches wide. One such machine is identified as Judelshon Model No. 317 Electronic Roll Cutter manufactured by Judelshon Industries, Inc. The cutting of larger rolls of web form materials is also contemplated according to the invention, for example, rolls in the nature of 90 inches or greater in diameter and of 350 inches or greater in length and weighing up to 5 tons or more. The invention may also be applied to the handling and cutting of smaller rolls that are not suitable for manual handling, for example, because of concentrated weight.

When it is considered that a 154 × 48 inch roll may weigh in excess of 3,000 pounds and that a spindle of a size to fit the roll may weigh in excess of 380 pounds it becomes apparent that the handling of the roll preparatory to the slitting operation and the handling of the slit rolls after the slitting operation presents a situation which virtually precludes reliance upon manual operations.

The aforementioned Model No. 317 Roll Cutter, provides a mechanism for moving a spindle mounted roll from an initial receiving position arcuately into an operative slitting position. The mechanism consists essentially of a pair of spindle end engaging arms fixed to a shaft mounted for power operated pivotal movement about an axis parallel with the cutter axis between receiving and operating positions. The outer ends of the arms are arranged to engage beneath the spindle ends at the receiving position and to encircle the spindle ends as the roll carried thereby is moved from the receiving position to the operating position. While this mechanism facilitates the handling of the roll to be slit and the plurality of rolls formed by the slitting operation, it is operable only after the roll has been mounted on the spindle. The mounting of the roll on the spindle and the removal of the slit rolls from the spindle presents an even more formidable handling problem.

An object of the present invention is the provision of a method and apparatus which will effectively solve this handling problem. This objective is obtained in accordance with the method principles of the present invention by moving a roll into an initial handling position wherein its axis is disposed generally parallel with the axis of rotation at the operative slitting position, supporting the weight of the roll along its lower exterior periphery at such initial handling position, disposing a spindle of a size to fit the spool of the roll with end portions extending outwardly thereof in an initial position spaced longitudinally from the roll with the axis of the spindle generally aligned with the axis of the roll, supporting the weight of the spindle at such initial position along the lower periphery thereof at a first position adjacent the end portion thereof adjacent the roll and at a longitudinally spaced second position at the remote end portion thereof, applying longitudinally opposed forces to the roll and to the remote rear end portion of the spindle acting in a direction toward one another to effect a relative longitudinal movement of the roll and spindle together from their initial positions to interengaged positions wherein the spindle is engaged within the spool of the roll and the end portions thereof extend outwardly of the roll, maintaining the aforesaid support of the roll throughout the aforesaid relative longitudinal movement, maintaining the aforesaid support of the spindle at the second position through the aforesaid relative longitudinal movement, progressively changing the support of the spindle at the first position longitudinally along the lower periphery of the spindle in a direction toward the second position during an initial portion of the relative longitudinal movement wherein the adjacent end portion of the spindle is engaged within the roll, removing the changing support of the said spindle during a final portion of the relative longitudinal movement, removing the application of force to the remote spindle end after the relative longitudinal movement and transferring the aforesaid support of the roll to the spindle by supporting the outwardly extending end portions of the spindle and laterally translationally moving the roll into the initial operative slitting position through support of the end portions of the spindle.

In accordance with the principles of the present invention, the aforesaid method steps are substantially reversed following the slitting operation in handling the slit rolls to the point where the spindle is removed therefrom and apparatus is provided for carrying out all of the procedural steps. In terms of apparatus, it will be understood that the step of moving the roll into the initial operative slitting position may be performed by the aforesaid arms of the spindle end handling mechanism when the slitting operation is carried out on the Model No. 317 machine heretofore mentioned. The roll supporting step may be conveniently performed by a conventional fork lift truck having a suitable roll supporting saddle structure fixed to the upper surface of the fork lift tines. A specially constructed elongated spindle handling device is utilized to carry out the handling steps relating to the spindle.

Another object of the present invention is the provision of an apparatus of the type described which is simple in construction, economical to manufacture and maintain, and efficient in operation.

These and other objects of the present invention will become more apparent during the course of the following detailed description and appended claims:

The invention may best be understood with reference to the accompanying drawings wherein an illustrative embodiment is shown.

Figure 1:
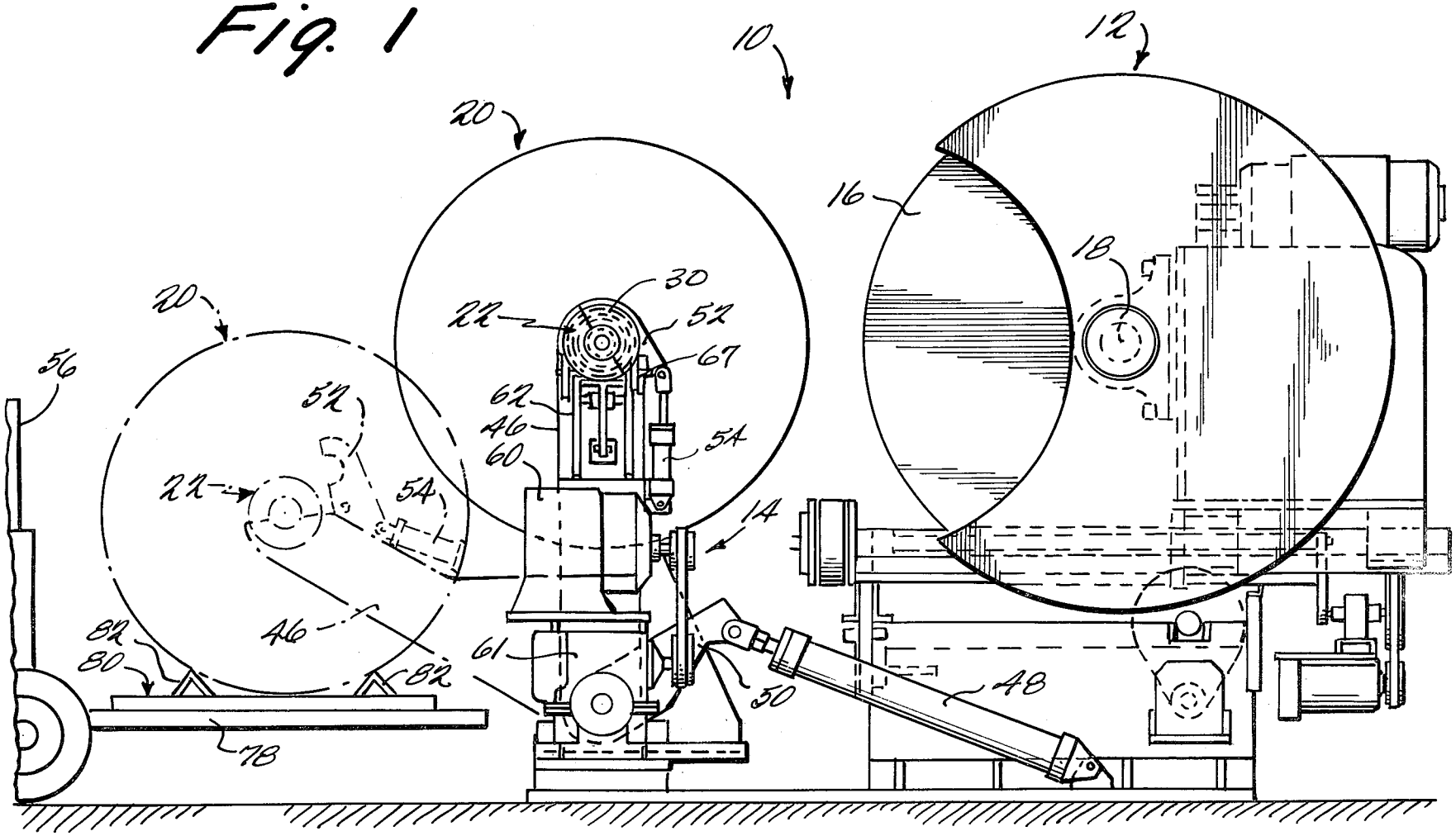
FIG. 1 is a side elevational view illustrating a slitting machine and a portion of the roll-handling apparatus embodying the principles of the present invention utilized in conjunction therewith.
Figure 2:
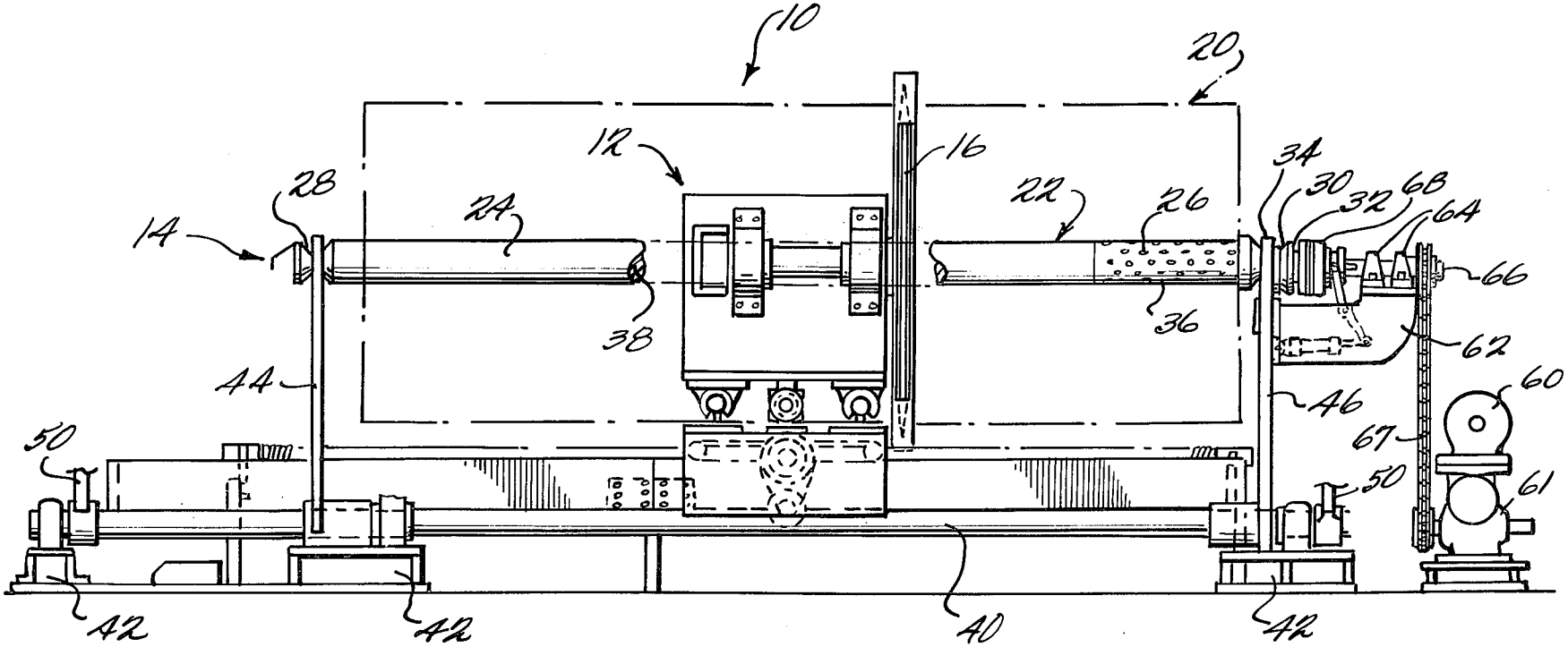
FIG. 2 is a front elevational view of the slitting machine shown in FIG. 2.

Referring now more particularly to FIG. 1 and 2 of the drawings, there is shown therein a slitting machine, generally indicated at 10, representative of Judelshon Model No. 317 Electronic Roll Cutter, which is a preferred machine utilized in conjunction with the apparatus of the present invention. As shown, the machine 10 include a cutting assembly, generally indicated at 12, and a roll handling assembly, generally indicated at 14. For present purposes, a detailed description of the construction and mode of operation of the cutting assembly 12 is not believed to be essential to an understanding of the present invention. Briefly, it will be noted that the cutting assembly 12 includes a circular cutting blade 16 of a diameter of approximately 60 inches fixed to a shaft rotatable about an axis indicated at 18. By utilizing a cutting blade of this size, the cutting assembly 12 is capable of slitting rolls of a diameter of 48 inches. In FIG. 1 there is shown a roll 20 which consists essentially of a length of web material, as, for example, non-woven textile fabric wound around a cylindrical spool in the form of a paper composition tube 2. The roll 20, as shown, has a width of approximately 144 inches and a diameter of approximately 45 inches. It will be understood that the principles of the present invention are applicable to rolls of the order of the sizes indicated above. The term "of the order of 144 × 45 inches " contemplates rolls of a comparable size which may vary below and above the above-mentioned specific figures, so long as the total size of the roll is sufficiently marked as to present weight problems in handling. The specific 144 × 45 inch roll has an interior spool diameter of 7 inches.

As best shown in FIG. 2, the roll 20 is adapted to cooperate with a spindle assembly, generally indicated at 22. The spindle assembly 22 includes an elongated stationary section 24 and a relatively short rotating section 26 disposed in side-by-side relation therewith. The stationary section 24 includes a grooved outer end portion 28 and the rotating section 26 includes an end portion 30 which includes an outer annular groove 32, an innertapered annular groove 34. The periphery of the rotating section 26 is provided with a multiplicity of radially movable pins 36 or the like which are adapted to be moved radially outwardly in response to the communication of air under pressure with the interior of the rotating section 26. In this way, the radially outward movement of the pins 36 serve to fixedly link the rotating section 26 of the spindle assembly 22 with the interior of the spool of the roll so that the latter will be driven about its axis in response to the rotational movement of the rotating spindle section 26. The stationary spindle section 24 has a flat, indicated at 38 in FIG. 2, formed on the surface thereof facing the cutting assembly 12 which permits the periphery of the cutting blade 16 to engage within the inner periphery of the spool of the roll during the completion of the slitting operation. It will be understood that the slitting operation is accomplished by moving the axis 18 of the cutting blade 16 horizontally to the left as shown in FIG. 1 from the initial position shown wherein the periphery of the cutting blade is disposed exteriorly of the exterior of the roll 20 to a final slitting position wherein the periphery of the cutting blade is disposed interiorly of the spool as aforesaid. It will also be understood that the cutting assembly 12 include a mechanism for adjusting the position of the blade longitudinally of the roll.

The roll handling assembly 14 includes a shaft 40 which is mounted for rotation about an axis parallel with the axis 18 as by bearing assemblies 42. Fixed to the shaft 40 in longitudinally spaced relation is a pair of spindle end engaging arms 44 and 46. As best shown in FIG. 1, the arms 44 and 46 are movable between a spindle receiving position, shown in dotted lines in FIG. 1 and an operative slitting position shown in solid lines in FIG. 1 by any suitable means such as a hydraulic piston and cylinder unit 48 having the cylinder end thereof pivoted to a fixed support and the piston end thereof pivoted to the outer end of an actuating lever 50, the inner end of which is fixed to the shaft 40.

The outer end of the arm 44 is configured to accommodate one-half of the peripheral configuration of the grooved spindle end 28 in indexed fashion so that when the spindle 22 is disposed in the operative slitting position, the flat 38 of the stationary spindle section 24 will be disposed in proper orientation facing the periphery of the cutting blade 16. The outer end of the other arm 46 is configured to rotatably receive one-half of the tapered groove 34. Each of the arms includes a cooperating pivoted cap member 52 mounted for movement, as by a hydraulic piston and cylinder unit 54, between an open position and a closed position, such as shown in FIG. 1. It will be understood that the cap member 52 associated with the arm 44 serves to hold the stationary spindle section 24 against movement out of its properly indexed position, while the cap member 52 associated with the arm 46 cooperates with the outer end configuration of the arm to rotatably support the rotatable spindle section 26.

The apparatus of the present invention includes a roll handling device, generally indicated at 56 and a spindle handling device, generally indicated at 58 which cooperate together and with the roll handling assembly 14 to assemble the spindle 22 within a roll 20 in a position so that the spindle ends can be engaged within the outer ends of the arms 44 when the latter are disposed in their spindle end receiving position so that the roll mounted on the spindle can be moved from the receiving position into the operative slitting position where the slitting operation takes place. It will be understood that during the slitting operation, roll 20 is rotatably moved about its axis and to this end there is provided a suitable rotative power source, such as an electrical motor 60 or the like drivingly connected to a gear reduction unit 61 suitably mounted in a position with its output shaft aligned with the axis of the shaft 40. Mounted on the arm 46 is a fixed mounting bracket 62 carrying bearings 64 within which is journaled a drive shaft 66. The axis of the drive shaft 66 is positioned such that it is aligned with the axis of the spindle 22 and is driven by the output shaft of the unit 61, as by a sprocket and chain assembly 67. An axially engageable drive clutch assembly 68 is carried by the mounting bracket 62 for drivingly connecting the end of the rotating spindle section with the drive shaft 66 when the latter is disposed in its operative slitting position. It will also be understood that the spindle assembly 22 includes an air pressure fitting (not shown) which is adapted to be connected with a source of air under pressure when the spindle assembly is disposed in its operative slitting position for actuating the pins 36 so as to insure that the roll 20 will be rotated in response to the rotation of the rotating spindle section 26 by the drive shaft 66. It will be understood that following the slitting operation, which is performed by horizontally moving the cuttling blade 16 through a cutting stroke from the position shown in FIG. 1, the cutting blade is then moved through a return stroke back into the position as shown.

It will be understood that the roll handling device 56 may be specially constructed, however, as shown the device 56 consists of a conventional fork lift truck which include the usual tines 78 upon which are rigidly mounted a specially constructed saddle structure 80 for engaging the lower periphery of a roll throughout a substantial portion of the width thereof so as to support the entire weight of the roll in a stable relation. As shown, the saddle structure 80 includes a pair of upwardly directed spaced angle irons 82 which serve to receive the lower periphery of the roll 20 therebetween. It will be understood that any conventional fork lift truck may be utilized, an exemplary embodiment being a Crown heavy-duty Walkie Stradle Stacker Model No. 20WTT. As will be apparent hereinafter, the significant movements provided by the fork lift truck are a horizontal transverse movement with respect to the axis of the roll supported thereby, a vertical transverse movement with respect to the axis of the roll supported thereby, and a longitudinal horizontal movement parallel with the axis of the roll supported thereby. Other types of movements such as a tilting movement are also provided although this movement is not considered to be essential.

In the embodiment shown, the fork lift truck 56 is provided as a permanent part of the apparatus and is maintained substantially at all times in the position as shown in FIG. 1 except for the limited horizontal transverse movement hereinafter to be described. Handling of the rolls to be slitted into supported relation with the saddle structure 80 may be accomplished in conventional fashion by fork lift trucks provided with spindles for engaging within the spool of the roll. Likewise, the slitted rolls may be conventionally handled in this fashion after the slitting operation.

As previously indicated, the spindle handling device 58 is preferably specially constructed and, as best shown in FIGS. 3–6, includes an elongated frame structure, generally indicated at 100, a remote spindle end supporting means in the form of a carriage assembly 102 mounted for longitudinal recipricating movement on the frame assembly 100, an adjacent spindle end portion variable and removable support means in the form of a vertically movable roller assembly, generally indicated at 104, carried by the end of the frame assembly 100 in a position adjacent the fork lift truck 56 and a force applying or moving means in the form of a power driven endless chain assembly, generally indicated at 106, carried by the frame assembly 100 and operatively connected with the carriage assembly 102 for effecting the aforesaid longitudinal recipricatory movement thereof.

The frame assembly 100 made be of any desired construction. As shown, the frame assembly includes a pair of upper horizontally extending frame members 108 which are preferably of channel configuration disposed with respect to each other so that the openings of the channels face one another. The frame assembly 100 also includes a plurality of vertical frame members 110 which serve to support the horizontal members 108 in vertically spaced relation above the floor surface and a plurality of horizontally extending cross members 112 which serve to maintain the frame members 108 in parallel horizontally spaced relation.

The carriage assembly 102 includes a main rectangular frame structure 114 of suitable rigid construction, as, for example, tubular members welded together in a skeletonized frame. The rearward end of the carriage frame 114 has a pair of rearward rollers 116 (see FIG. 4) journaled thereon in depending relation, which rollers ride within the channel members 108. Mounted in depending relation to the central portion of the carriage frame is a second pair of rollers 118 (see FIG. 5) which likewise ride within the tracks provided by the channel members 108. In this way, carriage assembly 102 is mounted for longitudinal recipricating movement on the frame assembly 100.

Figure 6:
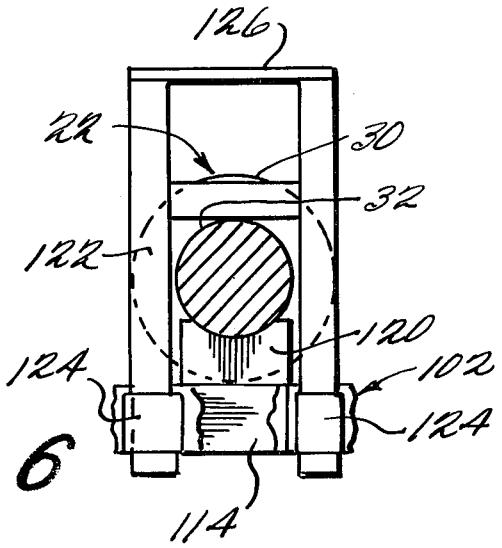
FIG. 6 is an enlarged fragmentary sectional view taken along the lines 6—6 of FIG. 3.

The forward upward surface of the carriage frame 114 is provided with a support element which, as best shown in FIG. 6 is in the form of a substantially saddle shaped member 120 of a size to engage the lower periphery of the annular groove 32 formed in the remote end portion 30 of spindle 22. The curved portion of the saddle member 120 supports the weight of the remote end of the spindle 22 when engaged thereon, while the forward surface thereof, which engages the corresponding transverse surface defining the groove 32, serves to transmit a longitudinal force in one direction to the spindle and the rearward surface thereof transmits a longitudinal moving force in the opposite direction. To assist in the application of the moving forces and to distribute the force application, there is provided a removable yoke 122, which is in the form of a U-shaped member the legs of which are adapted to engage downwardly within vertically extending sockets 124 rigidly secure to the forward end of the carriage frame. The legs of the U-shaped yoke 122 extend upwardly and are connected with a handle portion 126 by which the operator manually engages and disengages the yoke 122 in the position as shown in FIG. 6.

Figure 5:
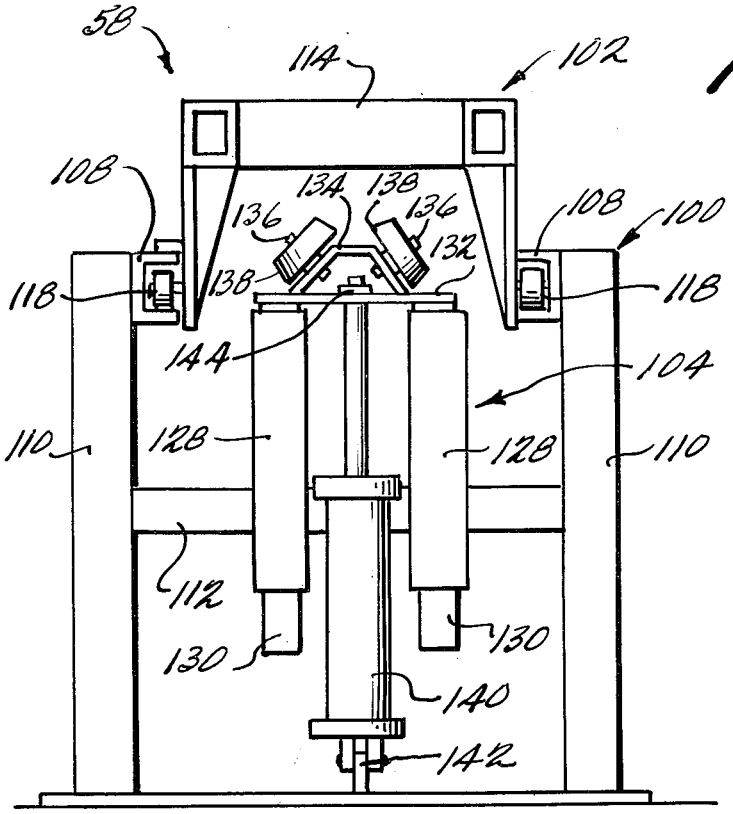
FIG. 5 is an enlarged fragmentary sectional view taken along the line 5—5 of FIG. 3.

As best shown in FIG. 5, the movable roller support assembly 104 is mounted at the forward end of the frame and includes a pair of parallel vertically extending guide tubes 18 rigidly secured to the forward end of the frame assembly 100. Slidably mounted within the guide tubes 128 is a pair of parallel posts 130, the upper ends of which are fixedly interconnected together by a cross member 132. Secured to the upper surface of the cross member 132 is a angle iron member 134 the legs of which are disposed at substantially 45° angles to the vertical. Mounted in the legs of the member 134 is a pair of stub shafts 136 which rotatably receive a pair of spindle engaging rollers 138. As can be seen from FIG. 5, the upper periphery of the rollers are shaped to supportingly engage the lower periphery of the spindle 22 so that the position of the support provided by the rollers is progressively changed when a relative longitudinal horizontal movement between the rollers and the spindle is accomplished.

In addition to the progressive changing of the longitudinal position of support, the assembly 104 also has the capability of being removed from supporting relation with the spindle and to accomplish this function, there is provided a piston and cylinder unit 140, the cylinder end of which is pivotly mounted in a fixed position, as indicated at 142 and the piston rod of which is connected to the central portion of the cross member 132 as indicated at 144.

The piston and cylinder unit 140 is preferably actuated by compressed air and preferably is of the double acting type. It will be understood that by communicating compressed air to the lower end of the cylinder, rollers 138 will be moved into a raised spindle supporting position. When the compressed air is reversed for application to the upper end of the cylinder, the supporting rollers 138 will be moved downwardly into the position shown in FIG. 5 and hence removed from supporting relation with the spindle.

Figure 3:
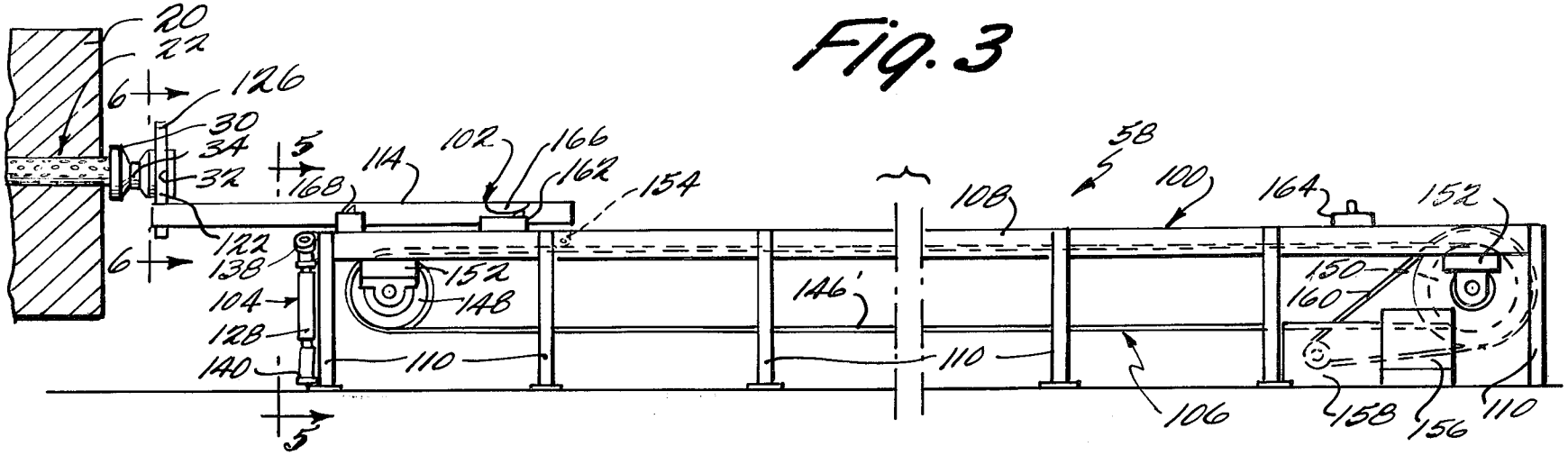
FIG. 3 is a side elevational view of the spindle handling device of the present apparatus.
Figure 4:
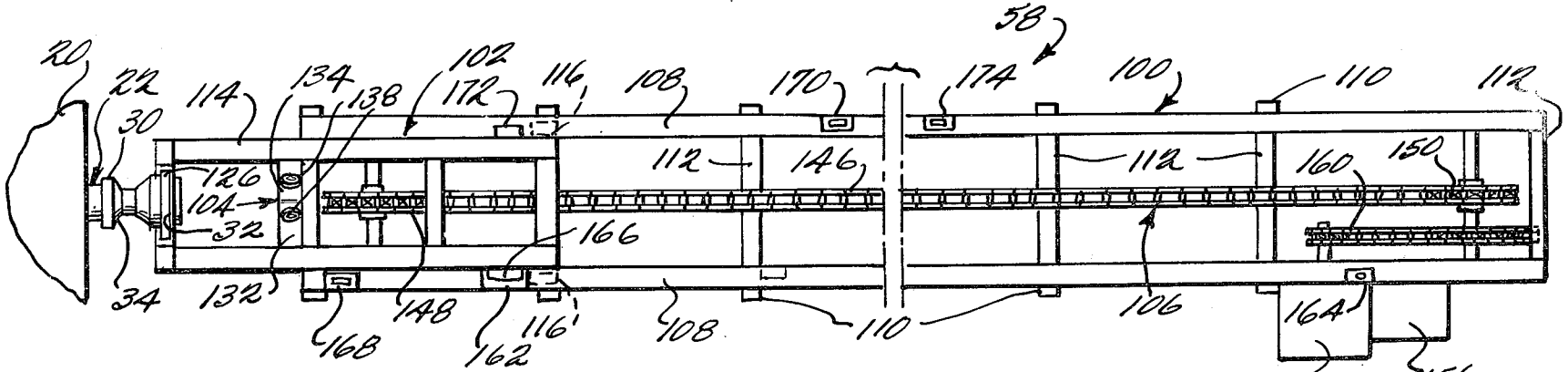
FIG. 4 is a planned view of the device shown in FIG. 3.

As best shown in FIGS. 3 and 4, the power operated chain assembly 106 is generally of conventional design and includes an endless chain 146 trained about a pair of longitudinally spaced sprocket wheels 148 and 150 mounted on the opposite ends of the frame assembly 100 by a suitable bearing assemblies 152 or the like so as to position the chain with an upper flight extending centrally between the channels 108 below the carriage frame 114. The carriage frame 114 is connected to the upper flight of the chain by any suitable means, as, for example, a depending lug 154 (see FIG. 3) which is pivotly connected with one of the links of the chain 146.

The assembly 106 also includes a power source which as shown is preferably in the form of a reversible electric motor 156, the output shaft of which drives a gear reduction unit 158. The output shaft of the gear reduction unit drives the rearward sprocket wheel 150 through a suitable chain and sprocket assembly 160.

It will be understood that both the valving for the piston and cylinder unit 140 as well as the switching for the reversible electric motor 156 could be simply manually controlled, however in the preferred embodiment shown a degree of automation has been provided. Specifically, reversing limit switches 162 and 164 have been mounted on the frame assembly 100 in positions to be engaged by a cam element 166 fixed to the carriage structure 114 when the latter reaches the ends of its reciprocatory movement. The limit switches 162 and 164 serve to de-energize the motor 156 so as to define the end of the travel of the carriage structure 114. The movement of the carriage structure 114 is initiated by a manual switch 168. The manner in which the manual and limit switches are interconnected with the motor to effect the above control is believed to be sufficiently conventional as to not warrant a schematic diagram thereof.

During the movement of the carriage structure 114 through its spindle inserting stroke, the piston and cylinder unit 140 is automatically actuated to remove the supporting engagement of the rollers 138 with the spindle 22. This automatic removal is accomplished by providing a valve 170 on the frame in a position to be engaged by a second cam element 172 fixed to the carriage frame structure 114 in a position to engage the valve 170 when the carriage frame has been moved through a predetermined initial portion of its spindle inserting stroke. A second reversing valve 174 is provided on the frame assembly 100 to be engaged by the cam element 172 during the movement of the carriage structure 114 in the opposite direction to actuate the piston and cylinder unit 140 upwardly so as to move the rollers 138 into supporting relation with the spindle 22. Here again, the valving is believed to be sufficiently conventional as to not warrant the illustration of a schematic diagram thereof.

METHOD AND OPERATION

Referring now more particularly to FIGS. 7–9, the method and operation of the present invention will now be described beginning with the movement of a roll 20 from inventory and ending with the movement of the slit rolls to a position of use. As previously indicated, a roll 20 to be slit may be conventionally moved from the inventory storage position by a fork lift truck (not shown) having a spindle provided in lieu of the conventional tines which is adapted to be engaged within the interior of the spool of the roll and then lifted to effect transportation. The roll 20 to be slit is thus moved from inventory storage into supported relation on the saddle structure 80 of the fork lift truck 56 in an initial handling position. In this position, the axis of the roll 20 is disposed in parallel relation with the axis 18 of the cutting blade 16 and in parallel relation to the operative slitting position of the roll. In the embodiment shown, the initial handling position is spaced a short distance horizontally from the receiving position, shown in dotted lines in FIG. 1, for reasons hereinafter more fully explained. It will be understood, however, that the receiving position may be coincident with the initial handling position also as will be hereinafter explained.

Figures 7A, 7B, 8A, 8B, 9A, 9B:
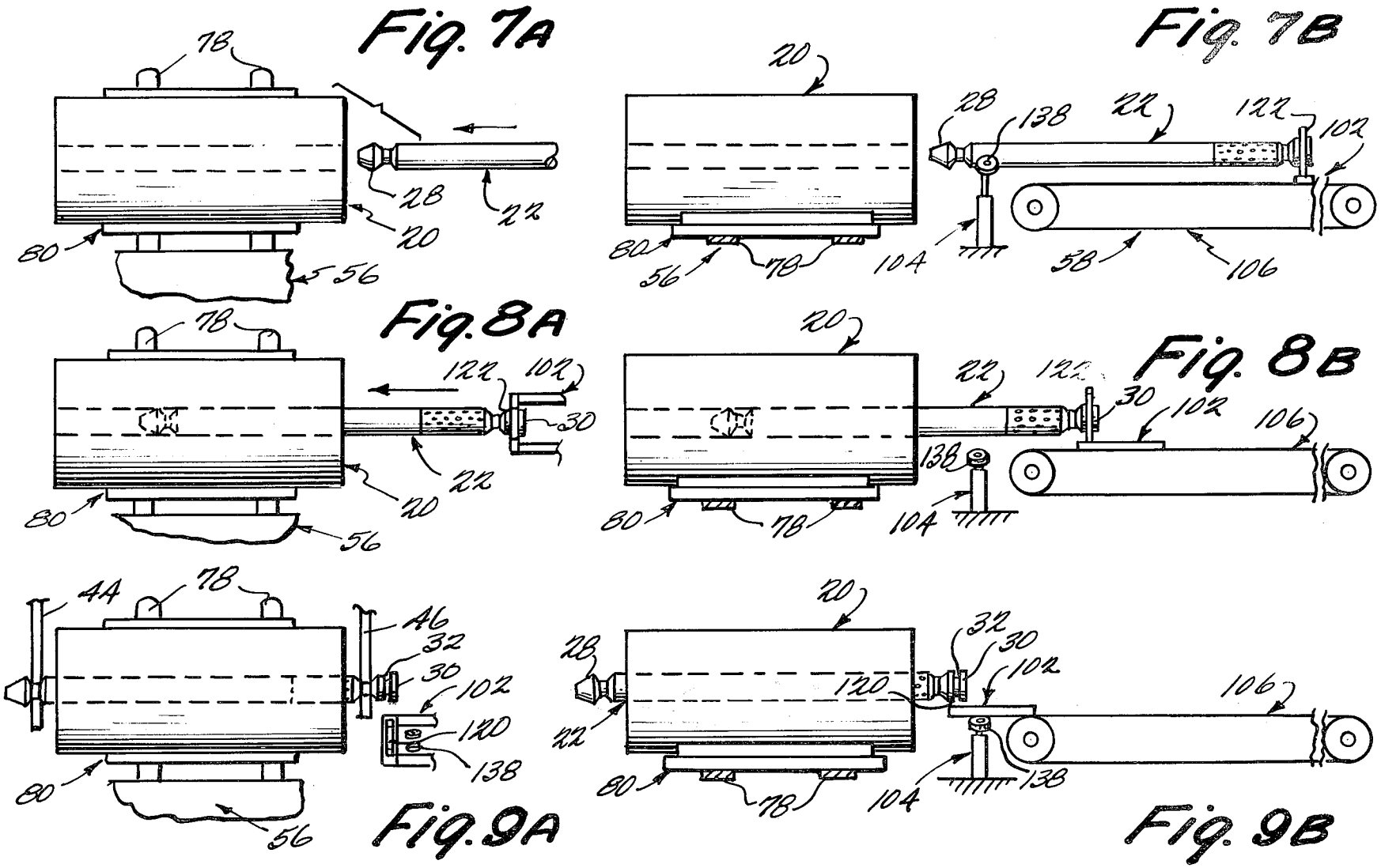
FIGS. 7 through 9 are schematic views illustrating the basic procedural steps of the present invention, each figure including a top plan view designated by the subscript A and a correspond side elevational view designated by the subscript B.

A spindle assembly 22 is likewise disposed in an initial handling position, shown in FIGS. 7A and 7B, spaced longitudinally from the roll 20 with its axis generally in alignment with the axis of the roll. In the initial handling position of the spindle, rollers 138 of the assembly 104 support the spindle at a first position adjacent to the end portion 28 which is disposed adjacent the roll 20. The remote end portion 30 is supported by engagement of the saddle member 120 within the lower periphery of the groove 32. Next, yoke 122 is manually engaged within the sockets in operative relation within the groove 32, as shown in FIG. 6. Next, the operator actuates the manual switch 168 which serves to actuate the motor 156 and effect movement of the upper flight of the chain 146 in a direction toward the left as viewed in FIG. 7B. This movement of the upper flight of the chain serves to apply a moving force through the carriage structure 114, saddle element 120 and yoke 122 to the remote end of the spindle 22, which force is opposed by the gravity force of the weight of the roll 20 disposed in supported relation on the saddle structure 80. It will be understood that while the weight of the roll 20 is normally sufficient to provide an opposing force sufficient to resist the movement of the roll in response to the movement of the spindle, an abutting structure may be provided in the saddle structure to positively resist or oppose the moving force applied to the spindle.

It will be noted that as the spindle 22 is moved longitudinally, the rollers 138 progressively change the support provided by the assembly 104 at the aforesaid first position in a direction longitudinally toward the second position of support at the remote end thereof. Also during this initial movement, the adjacent end portion 28 of the spindle will be moved within the interior of the spool of the roll 20. After an initial portion of this movement, which portion is determined by the engagement of the cam element 172 with the valve 170, piston and cylinder unit 140 is actuated to lower the rollers 138 and thus remove the changing support of the spindle provided thereby, which support is now assumed by the roll by virtue of the engagement of the spindle end portion 28 within the interior of the spool as aforesaid. This position is shown in FIGS. 8A and 8B.

It will be understood that the movement of the carriage assembly continues until the limit switch 162 is engaged by the cam element 166 at which time the spindle 22 is disposed in a final interengaged position within the roll 20 wherein the end portions 28 and 30 extend outwardly thereof.

In the operation of the apparatus as described above, the operator then disengages the yoke 122 through manual engagement of the handle 126, actuates the fork lift truck 56 to raise the roll and interengage spindle upwardly. This upward movement serves to disengage the saddle element 120 from supporting relation. The operator then actuates the fork lift truck 56 to move the roll and interengaged spindle forwardly into a position as shown in FIGS. 9A and 9B, which corresponds with the receiving position shown in dotted lines in FIG. 1.

This horizontal movement is necessitated by the occasion to provide clearance of the drive shaft 66 and other structure carried by the mounting bracket 62 fixed to the arm 46 with respect to the forward end of the carriage structure 114. It will be understood that by modifying the assembly 14 so that the mounting bracket 62 and the associated structure carried thereby is disposed in a fixed position corresponding to the operative position, the clearance problem is not presented and it would be possible to provide for the initial handling positions to be coincident with the receiving position shown in dotted line in FIG. 1. With a modification of this type the necessity to provide for horizontal movement of the roll supporting structure would be eliminated. Moreover, the need for vertical movement of the roll supporting structure would be eliminated except for the necessity to accommodate rolls of various diameter size.

It will be understood that once the fork lift truck 56 has moved the roll with the spindle interengaged therein into the receiving position as shown in FIG. 1, hydraulic cylinder 48 can be actuated to move the arms 44 and 46 upwardly into engagement with the lower periphery of the associated spindle grooves. As the arms move upwardly, the support of the roll is transfered from the saddle structure 80 to the arms 44 and 46 through the spindle 22. During the movement of the arms from the receiving position into the operative position, cap members 52 are moved into closed position. When the arms reach the operative position, clutch assembly 68 is engaged and the source of air under pressure is connected with the interior of the rotatable section of the spindle to drivingly engage the pins 36 with the spool surrounding the same. The machine pin is now ready to perform the cutting cycle.

After the cutting cycle has been performed, the above handling steps are substantially reversed to provide a plurality of slit rolls in a final handling position separated from the spindle assembly.

This reverse operation consists essentially of disengaging the drive clutch 68 and the aforesaid pressure connection, actuating the hydraulic cylinders 48 to move the arms from their operative position into their receiving position, during which movement the cap members move into an open position. During the final portion of the movement of the arms, the support of the roll is transfered from the arms through the spindle to the saddle structure 80 of the fork lift truck 56. The fork lift truck is then actuated to move the roll horizontally into a position of clearance with respect to the arms which position corresponds with the initial handling position. Next, the fork lift truck is actuated to lower the roll and interengaged spindle so that the remote end 30 and specifically the groove 32 therein engages in supported relation with the saddle element 120 on the carriage structure 114. Next, the operator manually engages the yoke member 122 and actuages the switch 168 to commence the withdrawal movement of the chain 146. After a predetermined portion of this movement, cam element 172 engages valve 174 which actuates the piston and cylinder unit 140 to move the rollers 138 upwardly into supporting relation with the lower periphery of the spindle 22. During the subsequent portion of the movement, the support provided by the rollers 138 is progressively changed in a direction longitudinally away from the remote end. During the final portion of this movement, the end portion 28 of the spindle is disengaged from the spool of the roll and the movement is completed when cam element 166 engages the limit switch 164.

It will be understood that in practicing the present invention it is essential merely that a relative longitudinal movement between the roll 20 and the spindle 22 takes place. In the preferred embodiment, this relative movement is accomplished by maintaining the roll 20 in a substantially stationary position and effecting a longitudinal movement of the spindle 22. It will be understood that the invention contemplates a procedure in which the spindle is maintained in a substantially stationary position and the roll is moved longitudinally or where both are moved. The movement of the spindle is preferred since it involves the movement of less mass than the roll.

Also, while the apparatus provides for a degree of automation, it will be understood that the entire operation could be totally automated, in which case the yoke 122 would be replaced by a power driven cap member similar to the cap member 52 utilized in the ends of the arms 44 and 46. Also, as previously indicated, total automation would be preferable where the clearance problems, mentioned above, are obviated and hence the roll handling device is completely simplified. The roll handling device, as previously mentioned, could be specially constructed and in the case of automation would preferably consist of a conveyor capable of handling the slit rolls to a point of ultimate use.

It thus will be seen that the objects of this invention have been fully and effectively accomplished. It will be realized however, that the foregoing preferred specific embodiment has been shown and described for the purpose of illustrating the functional and structural principles of this invention and is subject to change without departure from such principles. Therefore, this invention includes all modifications encompassed within the spirit and scope of the following claims.

What is claimed is:

1. A method of handling a roll comprising a length of web material wound around a cylindrical spool, particularly a roll of a large size having a width of the order 144 inches and a diameter of the order of 45 inches, for slitting into a plurality of rolls of equal diameter and lesser width by rotating said roll and a circular cutter about their axes in parallel relation at an initial slitting position wherein the exterior periphery of the cutter is exterior to the exterior periphery of the web material of the roll and effecting a relative lateral movement between said roll and said cutter from said initial slitting positions to final slitting positions wherein the exterior periphery of the cutter is interior of the interior periphery of the spool of said roll, said handling method comprising the steps of moving a roll into an initial handling position wherein its axis is disposed generally parallel with the axis of rotation at said initial slitting position, supporting the weight of the roll along its lower exterior periphery at said initial handling position, disposing a spindle of a size to fit said spool with end portions extending outwardly thereof in an initial position spaced longitudinally from said roll with the axis of said spindle generally aligned with the axis of said roll, supporting the weight of said spindle at said initial position along the lower periphery thereof at a first position adjacent the end portion thereof adjacent said roll and at a longitudinally spaced second position at the remote end portion thereof, applying longitudinally opposed forces to said roll and to the remote rear end portion of said spindle acting in a direction toward one another to effect a relative longitudinal movement of said roll and spindle together from said initial positions to interengaged positions wherein said spindle is engaged within the spool of said roll and the end portions thereof extend outwardly of said roll, maintaining the aforesaid support of said roll throughout the aforesaid relative longitudinal movement, maintaining the aforesaid support of said spindle at said second position through said relative longitudinal movement, progressively changing the support of said spindle at said first position longitudinally along the lower periphery of the spindle in a direction toward said second position during an initial portion of said relative longitudinal movement wherein the adjacent end portion of said spindle is engaged within said roll, removing the changing support of said spindle during a final portion of said relative longitudinal movement, removing the application of force to said remote spindle end after said relative longitudinal movement, transferring the aforesaid support of said roll to said spindle by supporting the outwardly extending end portions of said spindle and laterally translationally moving said roll into said initial slitting position through the support of the end portions of said spindle.

2. A method as defined in claim 1 wherein said roll is held substantially stationary during said relative longitudinal movement.

3. A method as defined in claim 2 including the steps of handling the plurality of rolls formed by slitting in side-by-side relation by substantially reversing the aforesaid handling procedural steps.

4. A method as defined in claim 1 including the steps of handling the plurality of rolls formed by slitting in side-by-side relation by substantially reversing the aforesaid handling procedural steps.

5. Apparatus for handling a roll comprising a length of web material wound around a cylindrical spool, particularly a large roll having a width of the order of 144 inches and to a diameter of the order of 45 inches, for slitting into a plurality of rolls of equal diameter and lesser width by rotating said roll and a circular cutter about their axes in parallel relation at an initial slitting position wherein the exterior periphery of the cutter is exterior to the exterior periphery of the web material of the roll and effecting a relative lateral movement between said roll and said cutter from said initial slitting positions to final slitting positions wherein the exterior periphery of the cutter is interior of the interior periphery of the spool of said roll, said handling apparatus comprising means for supporting the weight of a roll along its lower exterior periphery at an initial handling position wherein its axis is disposed generally parallel with the axis of rotation at said initial slitting position, first and second means for supporting the weight of a spindle of a size to fit the spool of the roll with end portions extending outwardly thereof at an initial position spaced longitudinally from the roll with the axis of the spindle generally aligned with the axis of the roll along the lower periphery thereof respectively at a first position adjacent the end portion thereof adjacent said roll and at a longitudinally spaced second position at the remote end portion thereof, means removably engageable with the remote end portion of said spindle for applying longitudinally opposed forces to said roll and to the remote rear end portion of said spindle acting in a direction toward one another to effect a relative longitudinal movement of said roll and spindle together from said initial positions to interengaged positions wherein said spindle is engaged within the spool of the roll and the end portions thereof extend outwardly of the roll, said first spindle supporting means including means for progressively changing the support of the spindle at said first position longitudinally along the lower periphery of the spindle in a direction toward said second position during an initial portion of said relative longitudinal movement wherein the adjacent end portion of the spindle is engaged within the roll and for removing the changing support of the spindle during a final portion of said relative longitudinal movement, and means operable after said relative longitudinal movement and the removal of the engagement of said force applying means with the remote spindle end portion for transferring the support of the roll by said roll supporting means to the spindle by supporting the outwardly extending end portions of the spindle so that the roll can be laterally translationally moved into said initial slitting position through the support of the end portions of the spindle.

6. Apparatus as defined in claim 5 wherein said roll supporting means includes a fork lift truck.

7. Apparatus as defined in claim 6 wherein said support transferring means comprises a pair of arms mounted for power operated pivotal movement between spindle end receiving and operative slitting positions, said arms having openings in the outer ends thereof for engaging beneath cooperative grooved sections of the end portions of the spindle and cap members mounted on the outer ends of said arms for movement between an open position when said arms are in said receiving position and a closed position encircling said grooved sections when said arms are in said operative slitting position.

8. Apparatus as defined in claim 7 wherein said second spindle supporting means comprises an elongated frame structure, a carriage structure mounted on said frame structure for horizontal longitudinal reciprocating movement with respect thereto, said carriage structure having a member for supportingly engaging the remote end portion of the spindle.

9. Apparatus as defined in claim 8 wherein force applying means includes a power driven endless chain mounted on said frame structure so as to provide a longitudinally extending operative flight, and means connecting said operative flight with said carriage structure.

10. Apparatus as defined in claim 8 wherein said carriage structure includes a plurality of longitudinally spaced pairs of transversely spaced rollers, said frame structure including a pair of longitudinally extending oppositely facing channel members receiving said rollers.

11. Apparatus as defined in claim 10 wherein the progressive support changing and removing means of said first spindle supporting means comprises roller means for engaging the lower periphery of the spindle and power operated means for effecting a vertical movement of said roller means between an upper progressive support changing position and a lower support removing position.

* * * * *